US008535125B2

(12) United States Patent
Starke et al.

(10) Patent No.: US 8,535,125 B2
(45) Date of Patent: Sep. 17, 2013

(54) FEED UNIT FOR FILLING A COIN MODULE WITH COINS

(75) Inventors: Christian Starke, Paderborn (DE); Thorsten Neumann, Paderborn (DE); Axel Grimm, Steinheim (DE); Stig Goepel, Osten (DE); Wilfried Meyer, Buxtehude (DE)

(73) Assignee: Wincor Nixdorf International GmbH, Paderborn (DE)

( * ) Notice: Subject to any disclaimer, the term of this patent is extended or adjusted under 35 U.S.C. 154(b) by 0 days.

(21) Appl. No.: 13/416,026

(22) Filed: Mar. 9, 2012

(65) Prior Publication Data

US 2012/0231721 A1 Sep. 13, 2012

(30) Foreign Application Priority Data

Mar. 10, 2011 (DE) ..... 10 2011 005 375

(51) Int. Cl.
*G07D 1/00* (2006.01)

(52) U.S. Cl.
USPC ..... 453/57; 453/18; 453/29; 453/49; 194/344; 221/256; 221/263; 222/170; 222/171; 222/172; 222/367; 222/427

(58) Field of Classification Search
USPC ..... 453/6, 10, 12, 13, 33–35, 49, 57; 194/345, 346, 349–351, 353; 414/223.01, 414/223.02, 224.01
See application file for complete search history.

(56) References Cited

U.S. PATENT DOCUMENTS

| | | | | |
|---|---|---|---|---|
| 1,378,720 | A | 5/1921 | Roeling et al. | |
| 2,256,976 | A * | 9/1941 | Ford | 99/358 |
| 2,289,002 | A * | 7/1942 | Fleming et al. | 453/5 |
| 2,646,805 | A | 7/1953 | Anderson | |
| 2,667,880 | A * | 2/1954 | Childers et al. | 453/49 |
| 3,121,435 | A * | 2/1964 | White | 453/8 |
| 3,174,488 | A * | 3/1965 | Rau | 453/3 |
| 3,196,887 | A * | 7/1965 | White, Jr. | 453/8 |
| 3,703,903 | A * | 11/1972 | Landis et al. | 453/57 |
| 3,707,244 | A * | 12/1972 | Hull et al. | 221/13 |
| 3,763,871 | A * | 10/1973 | Jobst | 453/12 |
| 3,942,542 | A * | 3/1976 | Erickson | 453/57 |
| 4,466,453 | A * | 8/1984 | Said et al. | 453/8 |
| 4,544,058 | A * | 10/1985 | Choderker et al. | 194/325 |
| 5,040,657 | A * | 8/1991 | Gunn et al. | 194/317 |
| 5,082,141 | A * | 1/1992 | Martin et al. | 221/278 |

(Continued)

FOREIGN PATENT DOCUMENTS

| | | | |
|---|---|---|---|
| DE | 102007002892 | A1 | 7/2008 |
| FR | 2515959 | A1 | 5/1983 |

(Continued)

*Primary Examiner* — Jeffrey Shapiro
(74) *Attorney, Agent, or Firm* — Patent Central LLC; Stephen A. Pendorf

(57) ABSTRACT

A feed unit for filling a coin module with coins improved in such a way that a plurality of coin modules can be filled or loaded with just one feed unit. The coin feed unit is a coin drum which is rotatable inside a shell. A coin stock compartment is provided into which coins can be filled via a charge aperture. A dispensing compartment is provided inside the coin drum from which coins can be taken out via the discharge aperture. A passage is arranged in such a way that coins get from the stock compartment into the dispensing compartment as the coin drum rotates around a pivot pin.

5 Claims, 3 Drawing Sheets

(56) References Cited

U.S. PATENT DOCUMENTS

| | | | | |
|---|---|---|---|---|
| 5,285,883 | A * | 2/1994 | Le Hong et al. | 194/317 |
| 5,484,215 | A * | 1/1996 | Fillod et al. | 400/120.18 |
| 5,735,379 | A * | 4/1998 | Schulze et al. | 194/346 |
| 6,050,388 | A * | 4/2000 | Gautherot | 194/317 |
| 2009/0215374 | A1 * | 8/2009 | Wingerter | 453/57 |
| 2010/0234985 | A1 * | 9/2010 | Shuren et al. | 700/223 |
| 2011/0130084 | A1 * | 6/2011 | Trenner et al. | 453/63 |

FOREIGN PATENT DOCUMENTS

| | | | |
|---|---|---|---|
| GB | 211345 | A | 2/1924 |
| GB | 596300 | A | 1/1948 |
| WO | 2007146705 | A2 | 12/2007 |

* cited by examiner

FEED UNIT FOR FILLING A COIN MODULE WITH COINS

BACKGROUND OF THE INVENTION

1. Field of the Invention

This present invention relates to a feed unit for filling a coin module with coins which comprises at least one coin storage means to receive coins and a shell surrounding said latter and which is provided with a charge aperture for filling coins into the storage means that can be closed off with the aid of a first closing element and a discharge aperture for dispensing coins from said storage means that is adapted to be closed off by a second closing element.

2. Description of the Related Art

It is prior known from DE 10 2007 002 892 A1 for a user by means of a so-called money box to feed coins to coin modules which are adapted to receive coin money and to pay coins out to customers and which for instance may be part of a cash system and/or a self-service terminal. Said money box comprises a coin storage means for keeping a stock of coins and an enclosure with typically two openings. A first opening is arranged as a charge aperture and serves for filling the coin storage means with coins. Loading the money box is usually done in a coin issuing station outside a sales room. The first opening is typically closable. A second opening is a discharge aperture and serves for dispensing coins from the coin storage unit. Said discharge aperture cannot be opened unless the money box is direct docked to a charge aperture and/or securely locked to a coin module. On opening the money box the coins are direct dropped from the coin storage means of the money box into a filler opening of the coin module which is for instance funnel-shaped, and are from there fed into a separate coin storage means of the coin module. Coins contained in the coin storage unit of the money box are normally unsorted. The money box is loaded with a mixture of different coins in line with what is the typical coin demand for a particular coin module to ensure that the coin module can be self-sufficiently used over a predetermined length of time. This condition is satisfied when it is possible at whatever time to pay out a demanded change to a customer.

Generally have money boxes been used with acceptable results in filling coin modules with coins, but one coin module only can be filled at a time from one money box because the full content of a coin storage means thereof is usually emptied into the coin module. This means that a separate money box has to be kept available for each coin module or that the money box needs to be filled with coins repeatedly. This is a very time consuming process especially in large-scale retail enterprises with a plurality of cash systems. Transport of money boxes by a valuables transport service hence involves considerable expense.

BRIEF SUMMARY OF THE INVENTION

It is an object of this present invention therefore to improve a feed unit for filling a coin module with coins in such a way that a plurality of coin modules can be filled or loaded with just one feed unit.

To achieve this object the invention is in conjunction with the generic clause of Patent Claim 1 characterized in that the coin storage means is in the form of a coin drum which is rotatably mounted inside a shell, which is provided with a coin stock compartment into which coins may be filled via a charge aperture and which comprises a coin dispensing compartment from which coins may be taken out via a discharge aperture, and that between the coin stock compartment and the dispensing compartment there is a passage provided of such design that coins get passed from the coin stock compartment to the dispensing compartment as the coin drum rotates around a pivot pin.

The invention provides for the coin storage unit inside the shell to have two storage chambers, namely one in the form of a dispensing compartment adapted to be emptied into the coin module while the coins stored in another storage chamber in the form of a coin stock compartment are being retained while the coin module is being filled. This means that the feed unit is not run empty completely when filling the coin module and affords the advantage that a plurality of coin modules can be filled by means of just one feed unit. Provision of only one feed unit moreover reduces space requirements such that transport costs for instance may be reduced.

To supply a further coin module with coins after a first coin module has been loaded it is possible to pass coins stored in the coin stock compartment to the coin dispensing compartment for the purpose of which there is a passage provided between these storage chambers. Rotating the coin drum around the pivot pin of the feed unit causes coins to pass from the coin stock compartment to the dispensing compartment through that passage. This implies that the dispensing compartment is filled automatically during said rotation. Another coin module can be charged after the dispensing compartment has again been filled with coins.

A preferred embodiment of the invention provides for the coin drum to comprise a drum shell and a closing element hinged thereto for closing a recess of the dispensing compartment. The coin drum is of very simple design featuring substantially just two assemblies which are very easy to mount. The pivot pin on which the coin drum is rotatable relative to its shell and a pivot pin of the closing element may for instance be arranged in parallel and in a spaced-apart relation.

In a modification of this invention has the closing element a supporting section and a closing section. The closing element is seated against the shell of the feed unit by its supporting section while in closed state such that the discharge aperture thereof is closed. The closing section is assigned to the dispensing compartment in such a way that it forms one wall of the dispensing compartment in the closed position and blocks the recess of the dispensing compartment. When in open state the closing section is so tilted relative to the closed position that the recess of the dispensing compartment is unblocked and that coins stored in said dispensing compartment can be dispensed via the recess of said compartment and the discharge aperture of the shell. The closing element may advantageously be of passive type. There is no need for any means to operate the closing element. The discharge aperture of the shell may be assigned to the closing element in such a way while in open position that the element is allowed to rotate freely around its pivot pin rather than being seated against the shell by its supporting section. It is for this purpose that the recess of the dispensing compartment blocked by the closing element may be arranged such that the coins stored inside said compartment exert pressure on the closing section by their own weight with the result that the closing element swings into the open position by the time the supporting section no longer contacts the shell.

Another modification of the invention provides for the coin drum to have two spaced-apart face-end walls and radial walls joining said latter. The radial wall is helical and as viewed in radial direction has an outer and an inner free marginal section. A radial offset between said outer and inner free marginal sections provides the recess of the dispensing compartment while a radial offset between the inner free marginal section and the radial wall of the coin drum shell defines the passage connecting the coin stock compartment to the dispensing compartment. Advantageously can the coin drum shell be formed of substantially three wall members in a particularly simple way. Passage and recess are in that case provided during assembly of the coin drum shell with no need for any specific working steps. The wall members may for instance be made of curved semi-finished material, particularly steel sheets or such like, by punching, cutting etc.

According to a still further modification of the invention is the coin stock compartment of larger size than the dispensing compartment. This affords advantages to the effect that large coin quantities can be stored in the coin stock compartment and that a plurality of coin modules can be successively filled. The coins kept available inside the coin stock compartment are portioned into separate batches by transferring part of the coins into the dispensing compartment due to rotation of the coin drum around its pivot pin and are from there emptied into a filler opening of the coin module.

Further advantages of this present invention are as disclosed in the subclaims.

BRIEF DESCRIPTION OF THE SEVERAL VIEWS OF THE DRAWINGS

The invention will now be described in closer details with reference to the accompanying drawings in which.

DETAILED DESCRIPTION OF THE INVENTION

Figure 1:
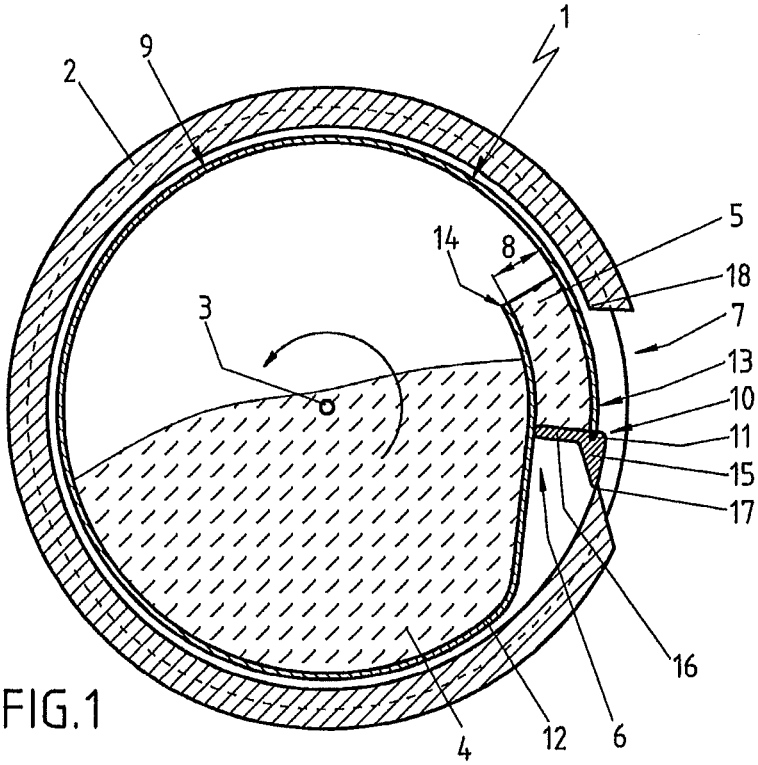
FIG. 1 shows the drum rotation position wherein coins from the stock compartment have been scooped into the upper compartment held closed by the closing element.
Figure 2:
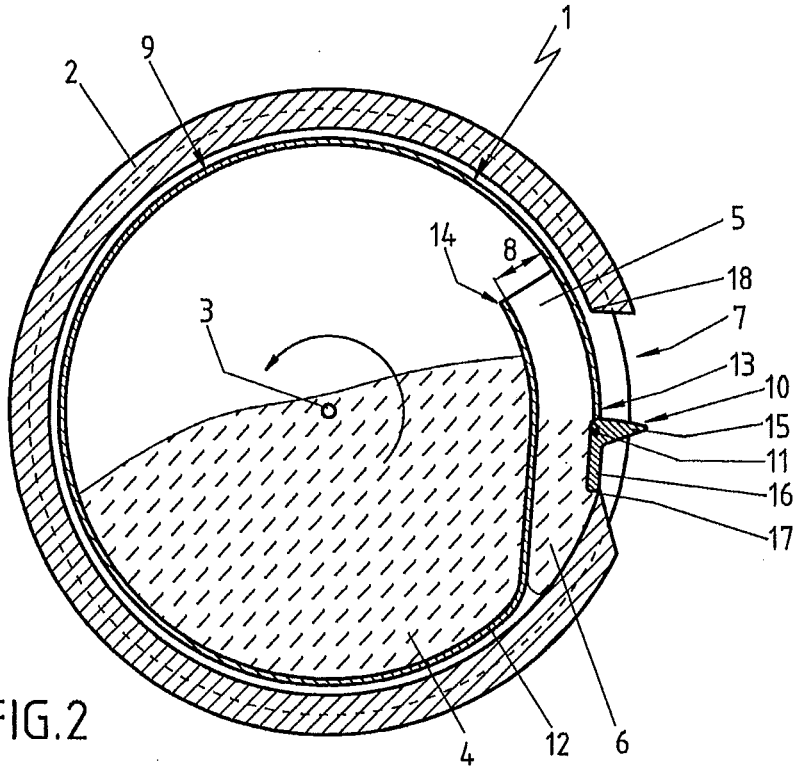
FIG. 2 shows the drum rotation position wherein the closing element has rotated to permit coins to drop into the recess.
Figure 3:
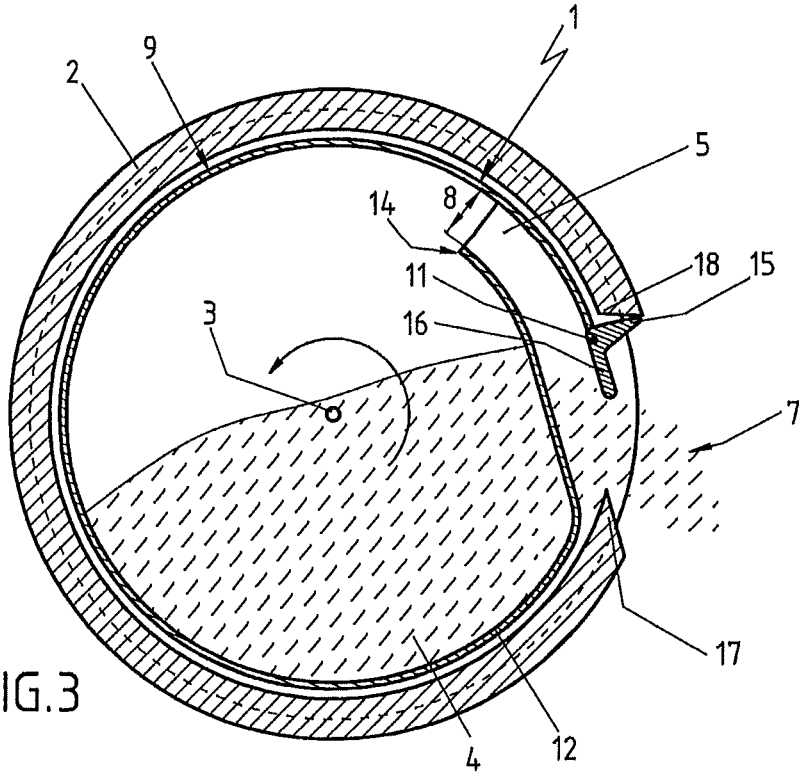
FIG. 3 shows the drum rotation position where discharge aperture is open and coins are being discharged.
Figure 4:
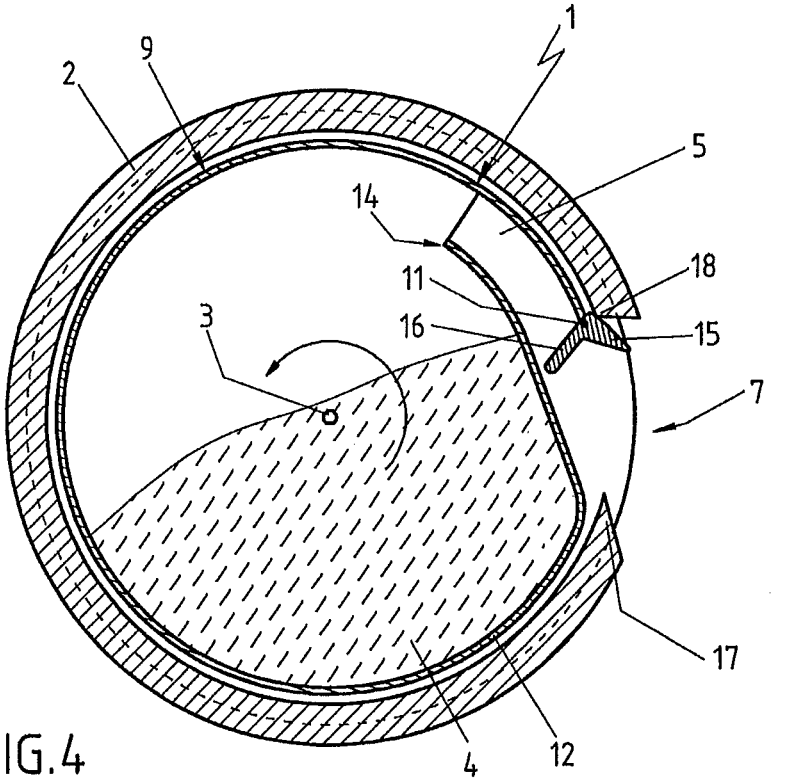
FIG. 4 shows closing element being pivoted back towards the closed position.
Figure 5:
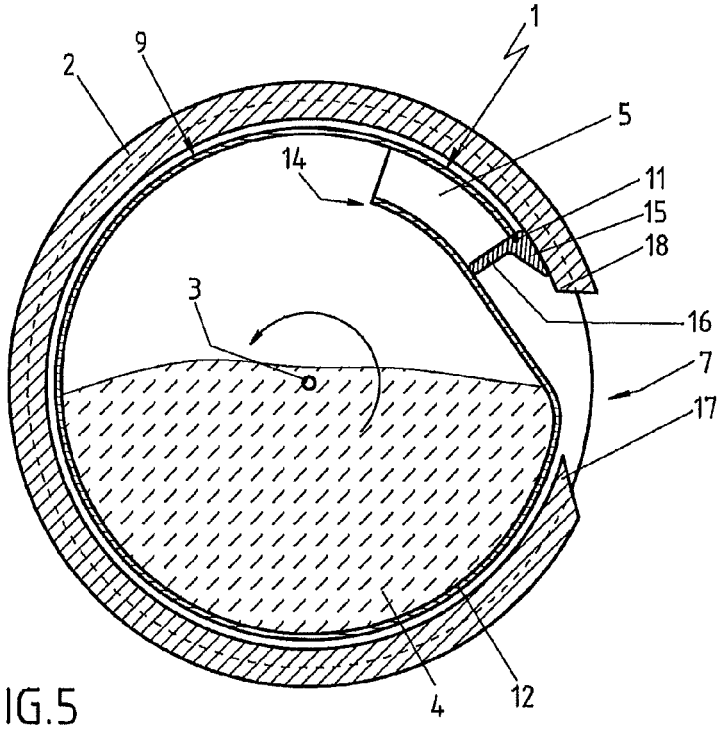
FIG. 5 shows dispensing compartment ready to be rotated through the coins to fill the dispensing compartment.

A feed unit of the present invention substantially consists of a coin drum 1 and a shell 2 enclosing said coin drum 1. The coin drum 1 is rotatably mounted on a pivot pin 3 inside the shell and provides a coin storage chamber having a larger-size coin stock compartment 4 and smaller-size dispensing compartment 5. Coin stock compartment 4 and dispensing compartment 5 are interconnected by a passage 8. Coins can be discharged from the dispensing compartment 5 via a recess 6 in that compartment and a discharge aperture 7 in the shell 2. The feed unit is provided with a not-shown charge aperture for filling the coin stock department. Coins are not drawn individually for the sake of better understanding. The extent to which compartments 4 and 5 are filled with coins is for example represented by the hatched areas of the coin stock compartment 4 and the dispensing compartment 5.

The feed unit according to the present invention may for instance be used in lieu of the money box presently used for loading a coin module of a cash system or self-service terminal with coins. The coin stock compartment 4 of the feed unit is filled with coins (usually in a specifically guarded coin issuing station) for that purpose. The feed unit is then joined to a charge aperture of a coin module. Part of the coins stored in the coin stock compartment 4 get into the dispensing compartment 5 via the passage 8 while those stored in the dispensing compartment 5 are emptied into the charge aperture of the coin module by opening the discharge aperture of the feed unit. The coins are finally passed from the charge aperture of the coin module into a coin storage unit thereof. Coins typically sorted by species in the storage unit are then stored in different coin magazines for instance.

The coin drum 1 comprises as substantial components a drum shell 9 and a closing element 10 which latter is rotatable on a pivot pin 11 in the drum shell 9. The coin drum shell 9 has two spaced-apart face-end walls and one radial wall 12 joining said face-end wall members. The radial wall 12 is helical and has a free outer marginal section 13 and a free inner marginal section 14 as viewed in circumferential direction. The recess 6 of the dispensing compartment 5 is formed between said free outer marginal section 13 and said radial wall 12. Passage 8 is similarly provided between the free inner marginal section 14 and the radial wall 12 of the coin drum shell 9.

The closing element 10 is pivotally mounted on the coin drum shell 9 in the area of said free outer marginal section 13. The pivot pin 11 is arranged parallel with and spaced from the pivot pin 3 of the coin drum 1. The closing element 10 is L-shaped having a first leg with a supporting section 15 and a second leg with a closing section 16.

Filling the dispensing compartment 5 with coins is achieved by rotating the coin drum around the pivot pin 3 anticlockwise. It is due to that rotational movement that the dispensing compartment 5 is filled with coins. Closing element 10 is in closed state during the filling operation. While in that closed position the closing element 10 is seated against the inner wall of the feed unit shell 2 by said supporting section 15. The closing section 16 of the closing element 10 obturates the recess 6 of the dispensing compartment 5 with the result that coins stored in said compartment are retained therein. Turning the coin drum 1 further in anticlockwise sense makes the supporting section 15 of closing element 10 sweep a forward retaining edge 17 of the shell 2 that is part of the margin of the discharge aperture 7. The supporting section 15 is in that case no longer seated against the inner wall surface of the shell 2 with the result that the closing element 10 swings around the pivot pin 11 in anticlockwise sense to make the closing section 16 open the recess 6 of the dispensing compartment 5 which means that the coins stored in that compartment 5 can be taken out of the dispensing compartment via the recess 6 and due to the rotational movement via the discharge aperture 7 to then get into the filler opening of an adjacent coin module.

On further rotating the coin drum 1 the supporting section 15 of the closing element 10 gets seated against a control edge 18 that confines the discharge aperture 7 on a side opposite to the afore mentioned retaining edge 17.

The closing element 10 is turned back to it closed position in clockwise direction whereupon another process of filling the dispensing compartment 5 can be initiated.

The open position of closing element 10 may be provided as a preferential state such that this position will be attained whenever a not shown spring member applies a reset force to the closing element 10 and that said element 10 no longer contacts the shell 2 of the feed unit by its supporting section 15. Provision for such a preferential position may be waived when the recess of dispensing compartment 5 is such that the coins stored inside that compartment 5 force the closing element 10 into the open position by their own weight.

Normally, the coin stock compartment 4 of coin drum 1 will be of larger size than the dispensing compartment 5. Due to the fact that the coin stock compartment 4 is larger than the dispensing compartment 5 it is possible to store a larger volume of coins in said stock compartment 4 than in the dispensing compartment 5. This permits to fill the dispensing compartment 5 several times with coins contained in the stock compartment 4 with the result that a plurality of coin modules can be successively filled with just one feed unit in the absence of any need to charge additional coins into the coin stock compartment 4.

Filling a not shown coin module with coins may be achieved in one or more steps. In the one-step filling mode are the coins stored in the coin stock compartment emptied into the filler opening of the coin module, counted inside that module and then passed into a coin storage means of the coin module. The feed unit is then separated from the coin module. In the case of multi-step filling of a coin module with coins the filling operation is repeated whenever the value of the coins transferred into the coin module is less than a defined coin demand for a particular module. In case of failure to cover the coin demand of the coin module the dispensing compartment 5 will again be filled with coins by rotating the coin drum 1 the way as described hereinbefore and emptied into the coin module via its filler opening. This process can be repeated until the coin demand of the coin module is fully covered. That multi-step filling mode may be adopted also to make sure that a minimum number of coins of each value are stored in the coin module.

The invention claimed is:

1. A feed unit for filling a coin module with coins, comprising:

a coin drum (1), and a shell (2) surrounding said coin drum (1), the shell being provided with a charge aperture for filling coins into the coin drum (1), wherein the charge aperture can be closed off by means of a first closing element, and a discharge aperture (7) for dispensing coins from said storage means that is adapted to be closed off with the aid of a second closing element, wherein the coin drum (1) is rotatably mounted inside the shell (2) and is provided with;

a coin stock compartment (5) from which coins may be taken out via the charge aperture, a dispensing compartment (5) from which coins may be taken out via the discharge aperture (7), the dispensing compartment (5) including a recess (6), a closing element (10) which is pivotably mounted on said shell for pivoting between an open position and a closed position, wherein the closing element (10) has a supporting section (15) and a closing section (16) and is seated against the shell (2) by its supporting section (15) and a closing section (16) and is seated against the shell (2) by its supporting section (15) while in closed position such that the discharge aperture (7) is closed by the coin drum (1), wherein the closing section (16) is assigned to the dispensing compartment (5) in such a way that in the closed position the closing section blocks the recess of the dispensing compartment (5) and in the open position is so tilted relative to the closed state that the recess (6) of the dispensing compartment (5) is unblocked, wherein the coins stored in the dispensing compartment (5) can be dispensed via said recess (6) of the compartment (5) and the discharge aperture (7) of the shell (2), wherein between the coin stock compartment (4) and the dispensing compartment (5) a passage is provided of such design that coins get passed from the coin stock compartment (4) to the coin dispensing compartment (5) as the coin drum (1) rotates around a pivot pin (3), and wherein the closing element (10, 11) is L-shaped having a first leg forming the support section (15) and a second leg forming the closing section (16).

2. The feed unit according to claim 1, wherein the shell (9) has two spaced-apart end walls and a radial wall (12) joining said end walls wherein the radial wall (12) has an outer free marginal section (13) and an inner free marginal section (14).

3. The feed unit according to claim 2, wherein the space bordered by the outer free marginal section (13), the inner free marginal section (14) and the radial wall (12) defines the passage.

4. The feed unit according to claim 2, wherein the closing element (10) is arranged on the shell (2) in the area of the outer free marginal section (13).

5. The feed unit according to claim 1, wherein the coin stock compartment (4) is of larger size than the dispensing compartment (5).

* * * * *